US007743923B2

(12) United States Patent
Conley

(10) Patent No.: US 7,743,923 B2
(45) Date of Patent: Jun. 29, 2010

(54) PATIENT CONTROLLED TIMED MEDICATION DISPENSER

(75) Inventor: N. Sharon Conley, Ormond Beach, FL (US)

(73) Assignee: Avanced MOD Corporation, Mt. Pleasant, SC (US)

( * ) Notice: Subject to any disclaimer, the term of this patent is extended or adjusted under 35 U.S.C. 154(b) by 1358 days.

(21) Appl. No.: 11/125,299

(22) Filed: May 9, 2005

(65) Prior Publication Data

US 2005/0258066 A1 Nov. 24, 2005

Related U.S. Application Data

(63) Continuation-in-part of application No. 10/247,427, filed on Sep. 19, 2002, now Pat. No. 7,044,302.

(60) Provisional application No. 60/323,521, filed on Sep. 19, 2001.

(51) Int. Cl.
*B65D 83/04* (2006.01)

(52) U.S. Cl. ..... 206/534.1; 221/1; 221/2

(58) Field of Classification Search ..... 206/528, 206/534.1, 538; 221/1, 2, 3, 6, 9, 10, 15, 221/113

See application file for complete search history.

(56) References Cited

U.S. PATENT DOCUMENTS 4,572,403 A * 2/1986 Benaroya ..... 221/3
4,662,537 A 5/1987 Wolf et al.
4,695,954 A 9/1987 Rose et al.
4,748,600 A 5/1988 Urquhart
4,785,969 A * 11/1988 McLaughlin ..... 221/2
4,811,764 A 3/1989 McLaughlin
4,911,327 A 3/1990 Shepherd et al.
4,962,491 A 10/1990 Schaeffer
5,246,136 A 9/1993 Loidl
5,323,929 A 6/1994 Marlar
5,372,276 A 12/1994 Daneshvar
5,392,952 A 2/1995 Bowden
5,441,165 A 8/1995 Kemp et al.
5,472,113 A 12/1995 Shaw
5,522,525 A 6/1996 McLaughlin et al.
5,564,593 A 10/1996 East, Sr.
5,582,323 A 12/1996 Kurtenbach
5,609,268 A 3/1997 Shaw
5,755,357 A 5/1998 Orkin et al.
5,850,937 A 12/1998 Rauche
6,021,918 A 2/2000 Dumont et al.
6,138,865 A 10/2000 Gilmore
6,145,697 A 11/2000 Gudish
6,163,736 A 12/2000 Halfacre
6,194,995 B1 2/2001 Gates
6,216,910 B1 4/2001 Numerick
6,219,587 B1 4/2001 Ahlin et al.
6,221,010 B1 4/2001 Lucas
6,234,343 B1 5/2001 Papp
6,304,797 B1 10/2001 Shusterman (Continued)

*Primary Examiner*—Jacob K Ackun, Jr.
(74) *Attorney, Agent, or Firm*—John L. DeAngelis

(57) ABSTRACT

The medication delivery device provides patient access to medications prescribed to be available on an as-needed basis, but with a minimum time intervals between doses. The device permits access to a single dose of the medication after each minimum time interval has elapsed. When the drug dose is removed from the device, the medication tray locks until the next minimum dosage time interval has elapsed.

4 Claims, 9 Drawing Sheets

U.S. PATENT DOCUMENTS

| | | | |
|---|---|---|---|
| 6,330,957 | B1 | 12/2001 | Bell-Greenstreet |
| 6,415,202 | B1 | 7/2002 | Halfacre |
| 6,439,422 | B1 | 8/2002 | Papp et al. |
| 6,507,275 | B2 | 1/2003 | Romano et al. |
| 6,510,962 | B1 | 1/2003 | Lim |
| 6,529,446 | B1 | 3/2003 | de la Huerga |
| 6,601,729 | B1 | 8/2003 | Papp |
| 6,662,081 | B1 | 12/2003 | Jacober et al. |
| 6,766,219 | B1 | 7/2004 | Hasey |
| 2003/0019879 | A1 | 1/2003 | Hubicki |
| 2003/0127463 | A1 | 7/2003 | Varis |

* cited by examiner

PATIENT CONTROLLED TIMED MEDICATION DISPENSER

CROSS-REFERENCE TO RELATED APPLICATIONS

This patent application is a continuation-in-part application claiming the benefit of the patent application assigned Ser. No. 10/247,427, filed on Sep. 19, 2002, now U.S. Pat. No. 7,044,302 which claims the benefit of the provisional patent application assigned Ser. No. 60/323,521 filed on Sep. 19, 2001.

FIELD OF THE INVENTION

The present invention relates generally to a medication dispenser, and more particularly to a time-controlled medication dispenser.

BACKGROUND OF THE INVENTION

Fifty percent of post-operative patients report inadequate pain relief. Fifty percent of all cancer patients and ninety percent of advanced cancer patients experience pain. Pain is now defined as "the fifth vital sign" as part of the mandate by the Joint Commission on Accreditation of Healthcare Organizations (JCAHO) to develop guidelines for pain management.

Adequate pain control requires the appropriate medication for the pain level and type reported. In a hospital setting, pain medication can be obtained only by a physician's order. Pain medications such as narcotics and nonsteroidals (and anxiety medications such as tranquilizers) are frequently ordered on an as-needed basis (referred to as prn orders). This approach requires the patient to initiate a request for each prn drug dose. The nurse determines whether the appropriate time interval has passed between doses, according to the physician's order. If the required time interval has elapsed, the nurse transports the medication to the patient's bedside and administers the medication to the patient. In some dosing regimens the patient is given a time-release pain medication at the same time(s) each day, with as-needed (prn) medications for breakthrough pain. Again the patient must request the medication for each breakthrough pain episode. A common reported patient frustration is the need to issue a request for each and every dose of prn medication. Thus a busy nurse must determine that the ordered time has elapsed from the last dosage, locate the medication and transport it to the patient in response to each request. This must also be accomplished in a timely fashion, as patients in pain must be administered to as soon as possible.

The as-needed approach to dosing provides the minimum amount of medication to adequately control symptoms, without the risk of abuse, overdosing and unnecessary side effects. Disadvantageously, in a hospital or institutional setting each medication that is dispensed on a prn basis requires nursing staff time and extra documentation by nursing and pharmacy staff, since the drugs can be administered only after the lapse of the predetermined time interval between doses. For example, a drug prescribed as needed every six hours may be given no more than four times in 24 hours. Such a drug may be administered from zero to four times in any given 24-hour period, depending upon patient dosage requests. If six hours have passed since the last administration of the drug, the medication is provided to the patient in response to the request. If six hours have not lapsed, the patient must wait the minimum time interval of six hours prior to receiving the next drug dose. In a home setting, the patient must remain aware of the restricted dosing schedule to safely self-administer these medications.

An automated bedside dispensing cabinet, requiring the nurse to enter the cabinet at times to dispense medications, is known. As with all prn medications, this device requires the nurse to visit the patient's room, where the medication is removed from the cabinet for dispensing. Although such a device reduces medication errors compared to the conventional approach, it expends valuable nursing time and expense.

It is also known that oral medications may be provided through the use of a sealed wrist pouch. The pouch is worn by the patient and filled with two medication doses. The pouch is refilled by a nurse at the patient's request. The patient reports the time of each self-administered dose and maintains a pain control diary. As in the other prior art devices, nursing staff time is required for refills and nursing staff availability may disrupt timely refilling of the pouch.

Drug delivery devices that remind the patient to take a medication at preset time intervals are known. These devices provide the reminder through a variety of signaling indicators, such as audible alarms, and promote compliance to a scheduled dosing regimen, but do not control nor prevent patient access to the medications at intervals shorter than prescribed.

Known PCA (patient controlled analgesia) intravenous pumps allow patients to self-medicate with pain medications. Using a PCA pump, under a physician's order, a patient receives a single dose of intravenous medication by activating a bedside button. The actuation starts a pump that delivers a measured dose of the intravenous drug (a narcotic, for example) at allowable time intervals. If the button is activated during a time interval in which an allowable dose has already been administered, the pump is "locked out" and unable to deliver the dose until the appropriate time interval has passed. This prevents the patient from taking more than a maximum allowable dose of medication during a measured time interval. The PCA device records the drug volume delivered over time. A nurse can query the device to chart the volume of drug delivered over a given time interval and the number of doses administered.

Two other dosing devices are available using the same principal as the intravenous PCA. These include pumps that deliver narcotic medications subcutaneously and epidural catheters that deliver pain medications near the spinal canal. Cancer patients experiencing both acute and chronic pain use such intravenous PCA pumps.

A randomized study of pain management in a post-operative setting using patient controlled analgesia (that is, the PCA pump) versus conventional pain therapy (CPT) (i.e., a request to the nurse for each administered dose), has been reported in the medical literature. Patient satisfaction for pain management in the PCA group was significantly better than that reported in the CPT group. Note, the only difference between the two study groups was the ability of the PCA group to easily and promptly self-control the medication dosing.

Multiple factors prevent the timely dosing of pain medication and other as-needed medications to the patient bedside according to conventional pain therapy techniques. A national survey of pharmacy practice in acute care settings in 1999 indicated that 75% of pharmacies still practice centralized pharmacy distribution systems. In some situations, these centralized pharmacies extend the time required to deliver medications to each patient area. A future medication-delivery trend includes automated medication dispensing stations in each patient area. Although this is a trend for the future, it is not as yet reality except in large, sophisticated, primarily academic hospitals. Currently there is a shortage of pharmacists and the existing staffs are over-burdened, creating further delays in drug delivery to the patient bedside.

In about 98% of the cases, nurses directly administer medications to patients. A time and motion study has reported that each prn oral medication delivered by a nurse to a hospital patient requires 18.42 minutes, which includes the unlocking of the narcotics cabinet to sign out the medication, transporting it to the patient's bedside, and documenting (charting) the time the dose is given. Like the pharmacy staff, nursing staffs are short-handed, while the number of complex hospitalized patients is growing. These patients have increasingly more complex diagnoses with more medication requirements.

Improved patient pain control leads to better patient outcomes in the hospital setting. This has been well documented in the surgical literature in the post-operative setting, with fewer post-operative complications, earlier rehabilitation, and shorter hospital stays for patients with better pain management. Better pain management is also highly cost effective since earlier discharges and few complications save health care dollars and staff time.

BRIEF SUMMARY OF THE INVENTION

According to one embodiment, the present invention comprises a medication dispenser for permitting administration of a medication dose to a patient only after a predetermined minimum dosing interval has elapsed. The medication dispenser comprises a medication tray comprising a plurality of compartments, wherein certain ones of the plurality of compartments contain a medication dose, a housing enclosing the medication tray, wherein the housing includes an opening and a controller for controlling the medication tray to align one of the plurality of compartments containing a medication dose with the opening after the minimum dosing interval has elapsed, thereby permitting the patient to access the medication dose through the opening.

According to another embodiment, the present invention comprises a method for dispensing a medication dose from a medication dispenser to an authorized patient on an as-needed basis. The method comprises: (a) determining that a first predetermined time interval has elapsed since a previous medication dose was made available to the authorized patient; (b) activating an indicator when the predetermined time interval has elapsed; (c) determining that a person is the authorized patient; (d) causing a medication-containing compartment of the medication dispenser to align with an opening in the medication dispenser, (e) wherein the authorized patient can access the medication dose through the opening and after a second predetermined time interval from step (d), causing a compartment that does not contain a medication dose to align with the opening.

BRIEF DESCRIPTION OF THE DRAWINGS

The foregoing and other features of the invention will be apparent from the following more particular description of the invention, as illustrated in the accompanying drawings, in which like reference characters refer to the same parts throughout the different figures. The figures are not necessarily to scale, emphasis instead being placed upon illustrating the principles of the invention.

DETAILED DESCRIPTION OF THE INVENTION

Figure 1:
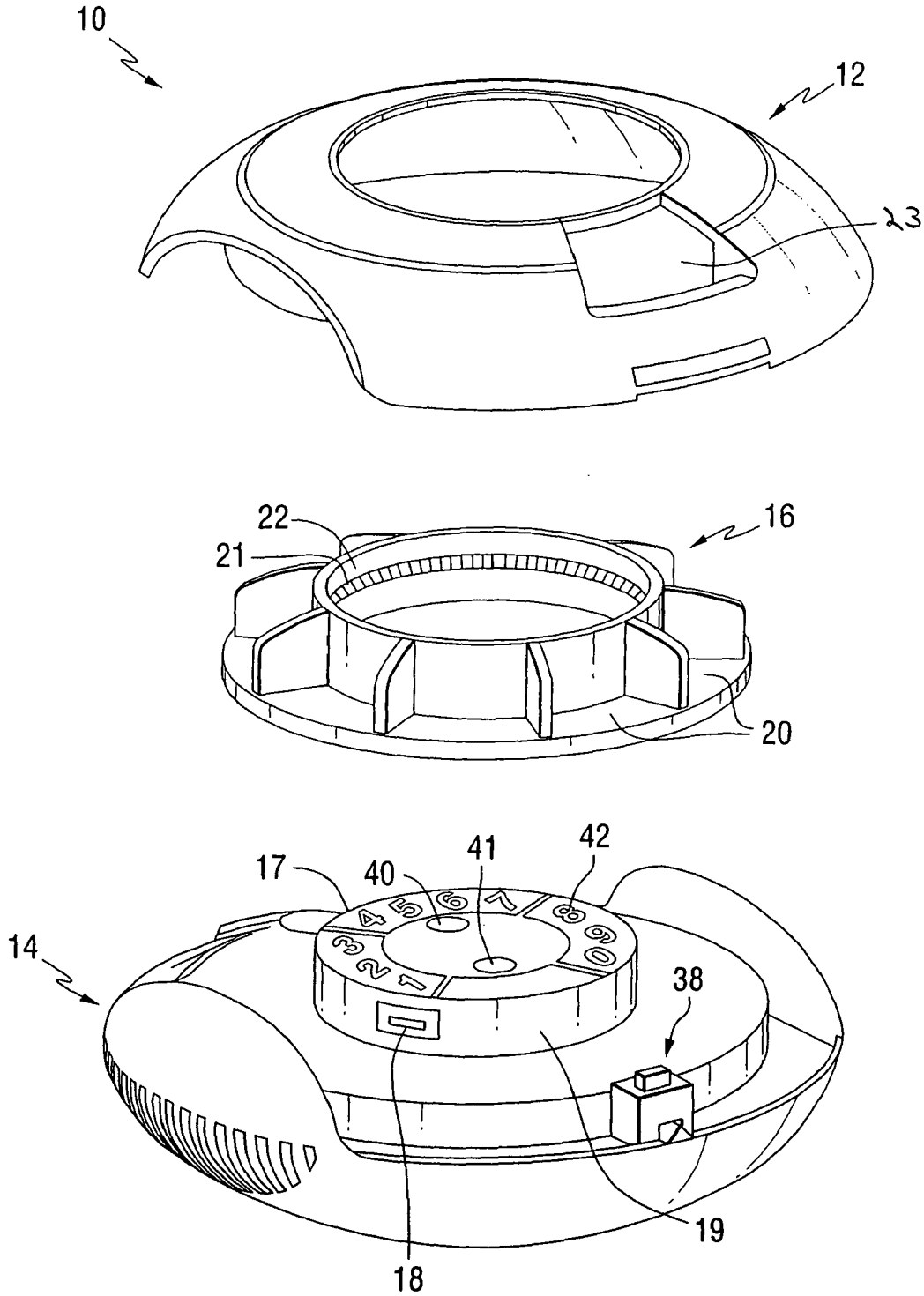
FIG. 1 is an exploded view of a medication on demand device constructed according to the teachings of the present invention.

Before describing in detail the particular medication dispenser in accordance with the present invention, it should be observed that the present invention resides primarily in a novel combination of hardware and software elements related to a medication dispenser. Accordingly, the elements have been represented by conventional elements in the drawings, showing only those specific details that are pertinent to the present invention, so as not to obscure the disclosure with structural details that will be readily apparent to those skilled in the art having the benefit of the description herein.

A medication on demand device 10 constructed according to the teachings of the present invention is illustrated in the exploded view of FIG. 1, comprising an upper assembly 12 for mating with a lower assembly 14 and capturing a medication tray 16 there between. The medication tray 16 is received by an upper surface enclosure 17 of the lower assembly 14. In one embodiment a motor (not shown in FIG. 1) is located within the upper surface enclosure 17. A gear 18 attached to a motor shaft protrudes from the vertical surface 19 of the upper surface enclosure 17 for drivingly mating with a circumferential gear track 21 disposed on an inner surface 22 of the medication tray 16. Thus rotation of the gear in response to the application of electricity to the motor causes rotation of the medication tray 16.

The upper assembly 12 includes a passage 23 for receiving a door (not shown in FIG. 1) providing access to one of a plurality of medication compartments 20 of the medication tray 16. Once the patient has opened and closed the door to remove the medication, a timing sequence is initiated and during that sequence the medication tray 16 is locked in place. After the dosing interval has elapsed, the medication tray 16 is rotated, through action of the motor and associated gearing, through an arc segment to align the passage 23 with the next one of the plurality of medication compartments 20. As described further below, the medication tray 16 is signaled to rotate, after a predetermined interval has elapsed since the last dosage, via entry of a patient code on a keypad of the device 10. The patient can then remove the next dosage for self-administration.

In the embodiment of FIG. 1 each one of the plurality of equally-sized medication compartments 20 carries a medication dose for administration to the patient. Preferably, the upper assembly 12 is translucent or transparent and the lower assembly 14 is opaque to provide a color contrast, making the medication dose easily visible within the plurality of medication compartments 20. In another embodiment a color-coded medication tray serves as an indicator of the drug type carried there within. In the pharmacy, the medication tray 16 can be loaded with medications, labeled to identify the patient and the minimum-dosing interval, and provided to the nurse attending the patient. While being transported, the medication tray 16 can be covered with a disposable cover.

A controller 30 (see FIG. 2) and its associated components control rotation of the medication tray 16 and allow patient access to the medications. In one embodiment the controller 30 is a microchip-based controller programmed to perform the various functions described herein. When the medication tray 16 is loaded into the device 10, the nursing or pharmacy staff enters the physician ordered dosing interval via an input device 34, comprising in one embodiment one or more manually operable switches. The controller 30 is responsive to the input device 34 for receiving and storing the dosing interval. The nursing staff also enters an authorization code, via the input device 34, that is stored in the controller 30, for later use to limit medication access only to the patient for whom the medications are intended.

Although the description herein generally refers to a nursing staff as the party exercising control over the operation of the device 10, this function can be performed by any third party ultimately controlling the patient's medication dosing, such as an in-home care giver, medical technician, pharmacy staff member, physician, etc.

The controller 30 is further bi-directionally responsive to a timer 36 for monitoring the time interval between permitted doses, and to a door sensor 38 (see FIG. 1 for the physical location thereof) for determining the door position. From the door position information, the controller 30 determines the times when the door is opened and closed by the patient to receive the medication for self-administration. After the patient has sequenced the door through an open and close cycle to remove the medication dose, the controller 30 activates the timer 36 to begin a counting sequence representing the dosing interval. When the timer 36 times out, the dosing interval has elapsed and the patient is permitted to administer the next dose. In response thereto, the controller 30 illuminates an indicator 40 (see also FIG. 1) indicating that the dosing interval has elapsed. In one embodiment the indicator 40 comprises a light emitting diode. The embodiment illustrated in FIG. 1 includes a second indicator 41, not required for proper operation of the device 10 that is illuminated during the time between permitted doses, serving as an indication that the patient is not permitted to administer the next medication dose.

Returning to FIG. 1, note that the upper surface enclosure 17 further carries a keypad 42 comprising a plurality of user-operable keys for entering an authorization code. After the indicator 40 is illuminated, the patient uses the keypad 42 to enter a predetermined authorization code that is supplied as an input to the controller 30. In one embodiment, the code comprises four digits and is followed by entry of an "enter" command on the keypad 42. If the patient-entered code matches the stored authorized code (previously entered when the medication tray 16 was loaded into the device 10 as described above), in response thereto the controller 30 energizes a motor 44 to cause rotation of the medication tray 16, as described above, such that the next medication compartment 20 is aligned with the passage 23. The patient now has access to the next medication dose. In one embodiment the motor 44 comprises a stepping motor that when energized controllably rotates only through a predetermined number of turns such that the next medication compartment 20 and the passage 23 are aligned.

The dosing timing cycle begins again when the door sensor 38 senses the opening and closing of the door, provides representative signals to the controller 30, and the controller 30 activates the timer 36.

If the patient's pain has subsided and he thus does not require a medication dose at the prescribed minimum interval, i.e., when the indicator 40 is illuminated, the patient can elect not to enter the prescribed authorization code. The device 10 remains in a ready condition such that whenever the code is entered the medication tray 16 is rotated and the next dose is accessible. Only an open and closing cycle of the door restarts the timing cycle.

The door open and close times determined as described above, are stored within the controller 30 and displayable on a clock 48 (disposed on the bottom surface of the lower assembly 14) in response to command queries entered into the input device 34. In one embodiment, the clock 48 comprises a countdown clock that displays the time remaining until the next permitted dose. The clock 48 is reset after each dose is administered. Nursing staff can also query the controller 30 to control the clock 48 to display the dose administration times, which can then be manually entered in the patient's chart.

In another embodiment where patient records are stored in a computing mechanism and associated storage media, the controller 30 is connected via a wired or wireless (RF or IR) network to the computing mechanism for automatically downloading these dose administration times and inputting them to the patient's record. According to such an embodiment, the controller 30 can also be programmed, with respect to the permitted dosing interval, authorization code authorized patient identification information, etc., through the wired (such as through a serial port included in the device 10) or the wireless network This feature avoids the need for a healthcare professional to physically visit the location of the device 10 to execute the programming function. Instead programming of a plurality of devices 10 is performed from a central location via a wired or wireless network that allows each device 10 to be individually accessed.

In an alternative embodiment, the clock 48 is operable as a teal time clock in response to commands entered into the input device 34 by nursing staff members.

Although the timer 36 is described herein as a separate component of the controlling mechanism of the device 10, those skilled in the art recognize that the timing function can be incorporated within the controller 30. Likewise, storage of the dosing interval, authorization code, etc., is described with reference to on-board storage in an internal memory within the controller 30. In another embodiment the device 10 includes external memory responsive to the controller 30 for storing program code and such data.

Figure 2:
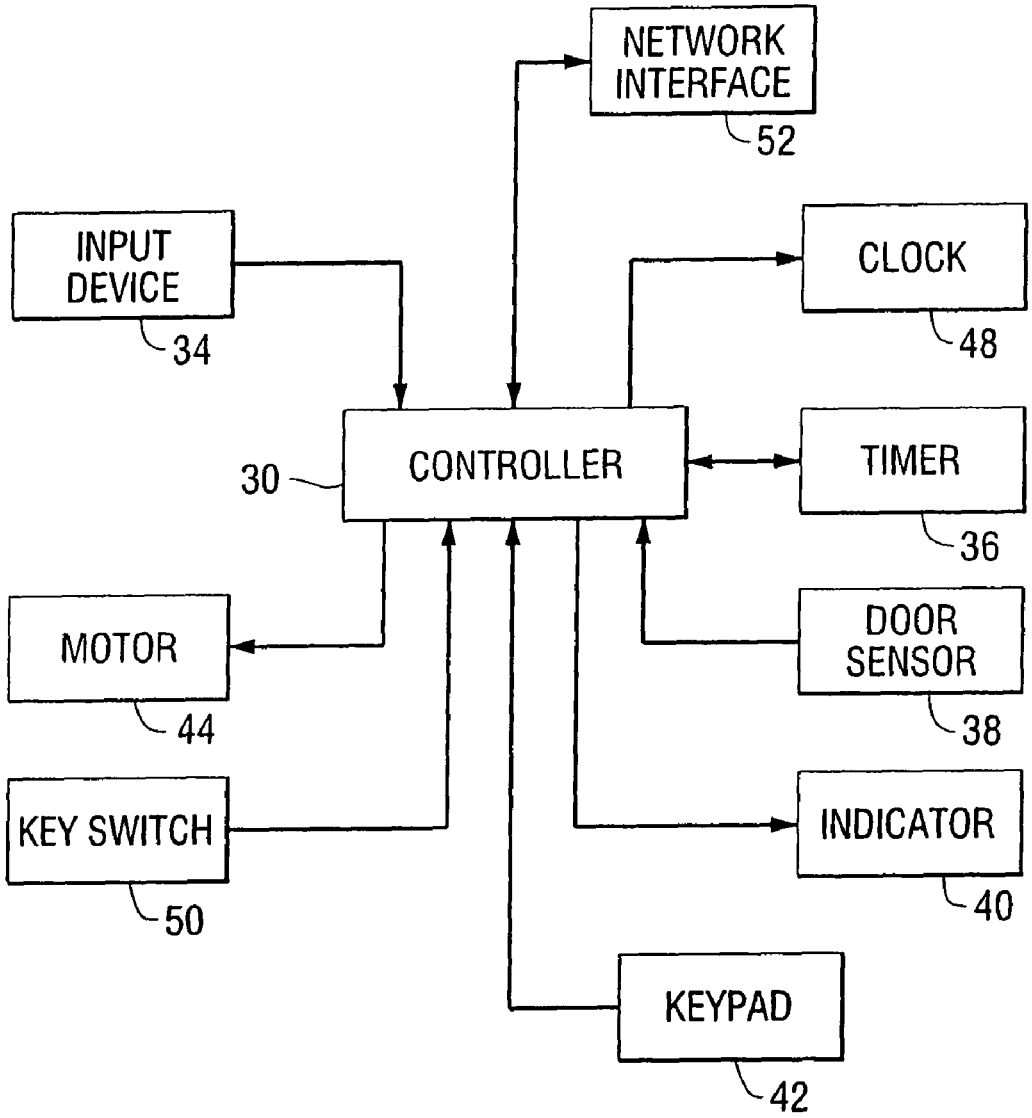
FIG. 2 is a block diagram of the control components of the medication on demand device of FIG. 1.

FIG. 2 further includes a key switch 50 for setting the operational mode for the device 10. In one embodiment the key switch 50 comprises a three-position key switch. A mating key is required to set the position of the key switch 50. Typically, this key would be accessible only to the nursing staff. In a first position the upper and lower assemblies 12 and 14 are separable for loading a new medication tray 16. Typically, the device 10 would be loaded with new medications doses every 24-hour period. Other time periods may apply depending on the dosing interval and the number of medication compartments 20 within the medication tray 16. In a second position the device 10 is locked and ready for patient use. In a third position the dosing interval, authorization code, etc., can be entered through the input device 34, and the controller 30 can be queried as to the times when the door 65 (see FIG. 3) was opened and closed.

FIG. 2 further includes a network interface 52 providing a wired or wireless connection to a remote computing device, such as a laptop or tablet computer or a personal digital assistant device. Various information collected by the controller 30, such as patient's dosing times and the minimum-dosing interval, is supplied to the remote computing device via the network interface 52.

Figure 3:
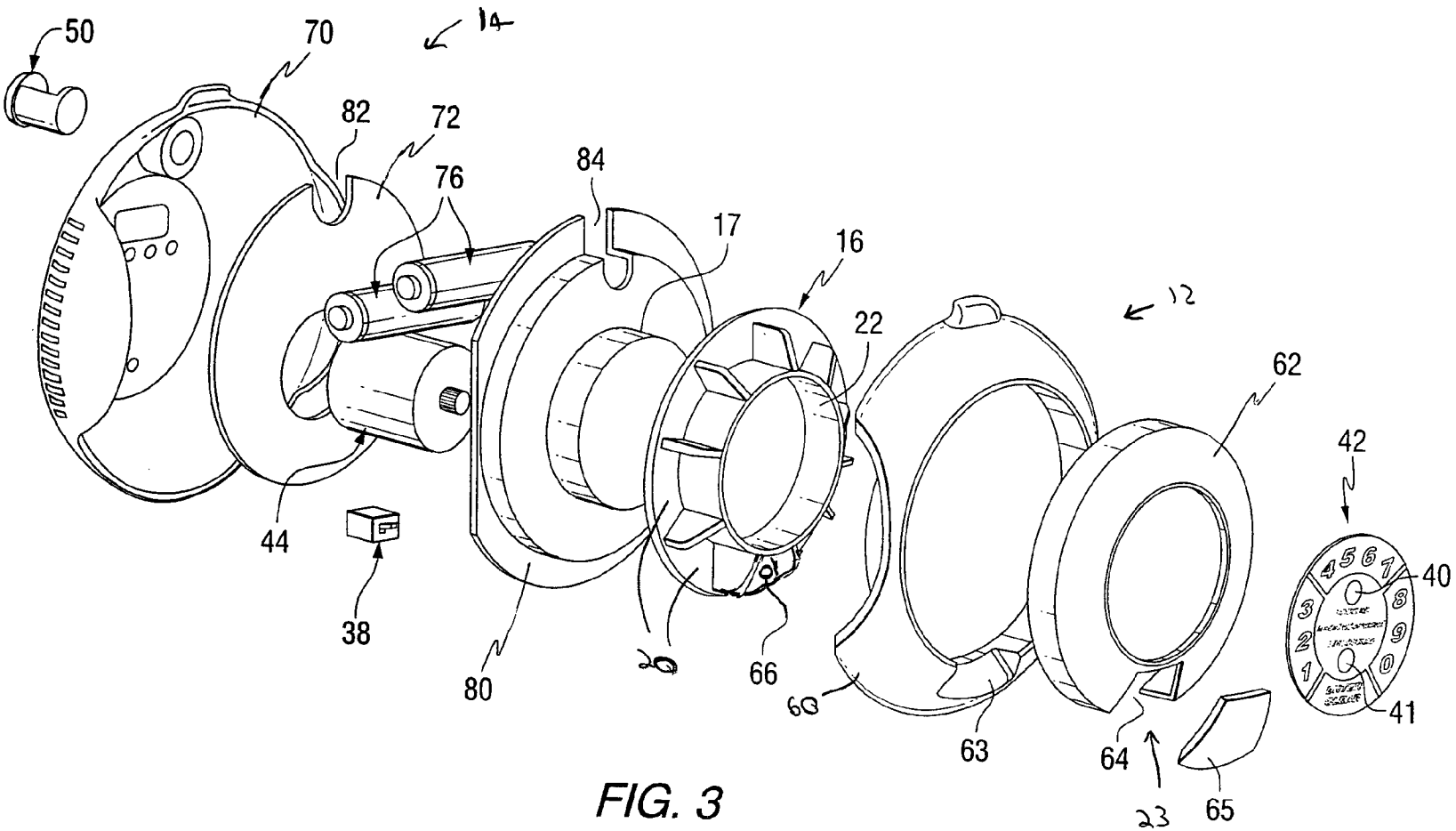
FIG. 3 is another exploded view of a medication on demand device constructed according to the teachings of the present invention.

A more detailed exploded view of the medication on demand device 10 is illustrated in FIG. 3, wherein the upper assembly 12 comprises a housing 60, for receiving a cover 62. A first region 63 of the passage 23 is formed within the housing 60 and a second region 64 thereof is formed within the cover 62. A door 65 provides access to the passage 23. A medication dose 66 rests in a medication compartment of 20 of the medication tray 16. Although the medication dose 66 comprises an orally administered dose, the teachings of the invention can be applied to other medication types, and thus such other medication types can be held within the compartment 20.

The lower assembly 14 further comprises a housing 70 carrying a circuit board 72 on which the controller 30 (not shown in FIG. 3) and its associated components are mounted. The motor 44, powered by batteries 76, is mounted within a housing 80. The key switch 50 passes through a notch 82 in the circuit board 72 and a notch 84 in the housing 80. The key switch 50 is electrically connected to the controller 30 as described in conjunction with FIG. 2.

Figure 4:
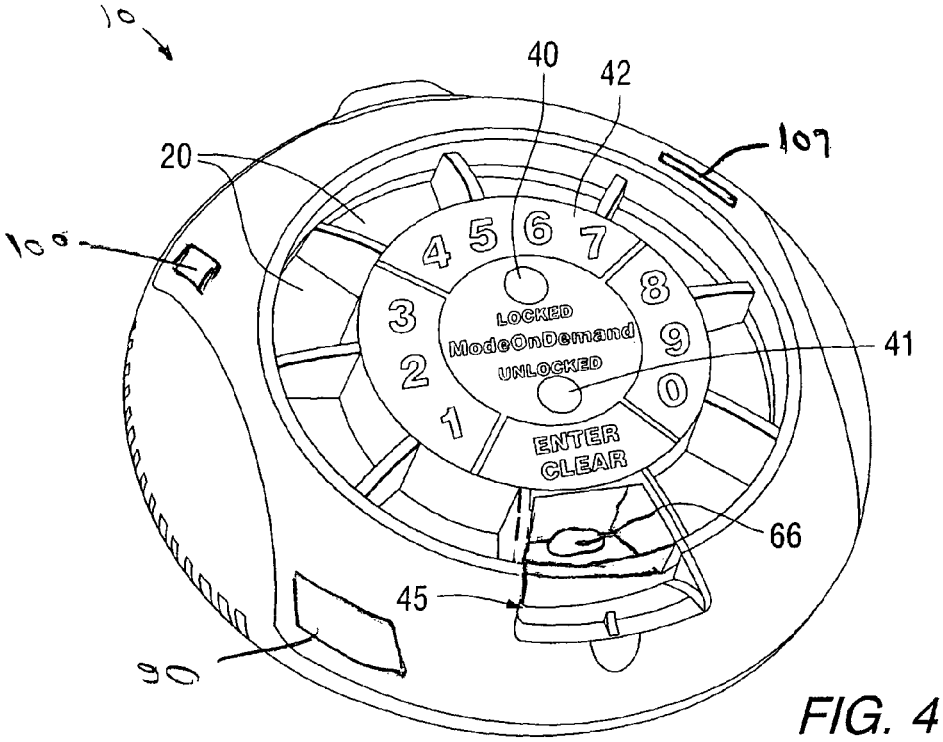
FIGS. 4 and 5 are top and bottom views, respectively, of the medication on demand device of FIGS. 1 and 2.

FIG. 4 is a top view of the medication on demand device 10 illustrating certain ones of the previously discussed components.

Although the patient authorization process described above comprises the entry of numeric or alphabetic characters via the keypad 42 to determine that the user is that authorized patient, other identification techniques for determining if the patient is authorized to receive the medication dose 66 can be employed, including fingerprint and voice print identification. These techniques, as known by those skilled in the art, prompt the user to enter a fingerprint or a voiceprint that is compared with a stored fingerprint or voiceprint of the authorized patient. If a match is indicated, the patient is provided with access to the next medication dose 66. The promptings and comparison functions can be performed by a suitable augmented controller 30, as known by those skilled in the art.

Figure 7:
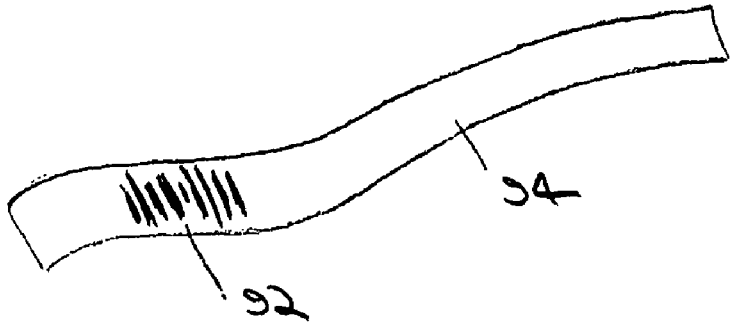
FIGS. 7, 8 and 9 illustrate various patient authentication devices for use with the medication on demand device of the present invention.

According to another embodiment, the device 10 comprises a bar code reader 90 (see FIG. 4) for reading a unique bar code 92 (see FIG. 7) assigned to the patient and printed on a patient's wristband 94 (see FIG. 7). If the stored bar code in the reader 90 matches the scanned bar code 92 and the minimum dosing interval has elapsed, the medication tray 16 is rotated under control of the controller 30, as described above, to provide patient access to the next medication dose. The implementation details associated with bar codes and bar code readers are known in the art.

Figure 8:
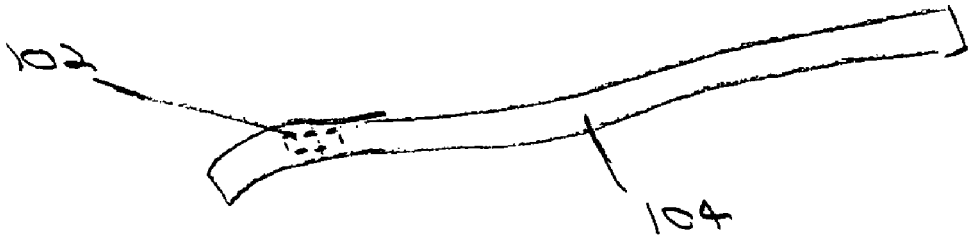

In yet another embodiment, an RFID (radio frequency identification) reader 100 (see FIG. 4) is included in the medication on demand device 10. The RFID tag reader 100 communications with a unique RFID code tag 102 incorporated into a patient's wristband 104 as illustrated in FIG. 8. The technology associated with RFID tags is known by those skilled in the art. Any of the known RFID technologies (magnetic or electromagnetic) can be used in conjunction with the medication on demand device 10 and the RFID reader 100 and tag 102.

Figure 9:
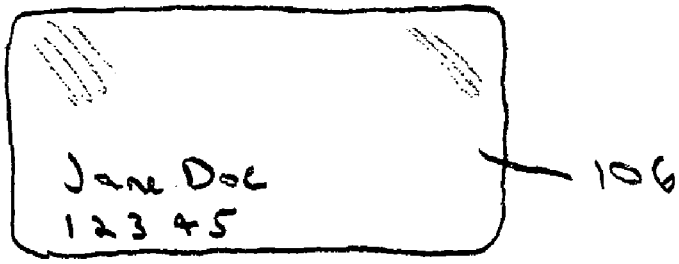

In still another embodiment, a patient is provided with a smart card 106 (see FIG. 9) for reading by a smart card reader 107 (see FIG. 4) within one embodiment of the device 10. Use of the smart card 106 and corresponding reader 107 offers another technique for determining that the user is the authorized patient.

Other person identification techniques are known in the art and can be incorporated into an embodiment of the medication on demand device of the present invention. The use of any such techniques are considered within the scope of the present invention.

Figure 5:
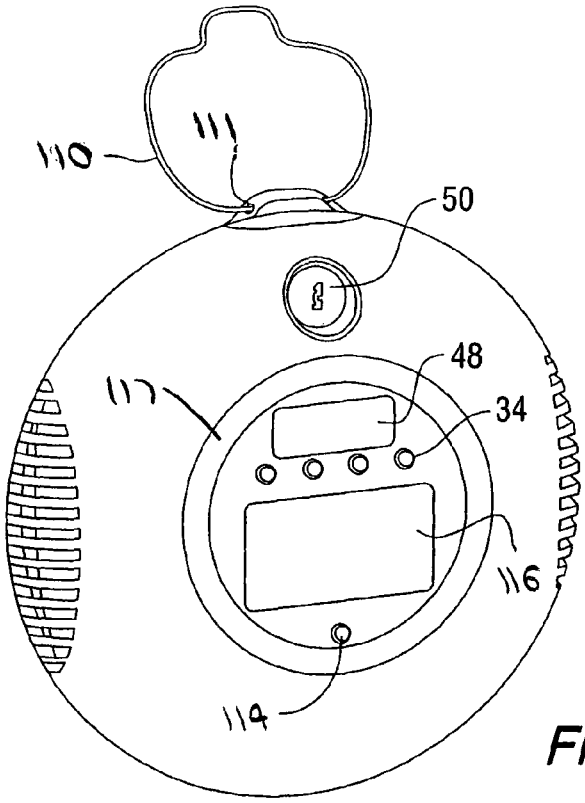

FIG. 5 is a bottom view of the medication on demand device 10 illustrating several of the previously described components of the device 10. A guide wire 110 for securing the medication on demand device 10 to a patient's bed, bedside table or tray passes through a loophole 111. The input device 34 and the clock 48 are also shown in the bottom view of FIG. 5.

The bottom surface of the device 10 further includes a low-battery indicator 114 and a recess 116 for receiving, for example, patient identification information, the medication type and dosage, and the minimum interval between doses. Typically, this information is recorded on adhesive-backed material received within the recess 116. The device 10 includes a stacking ring 117 for mating with a receiving recess in the upper assembly 12 of a second device 10, thus allowing several devices 10 to be transported and stored in an efficient and stable configuration.

Figure 6:
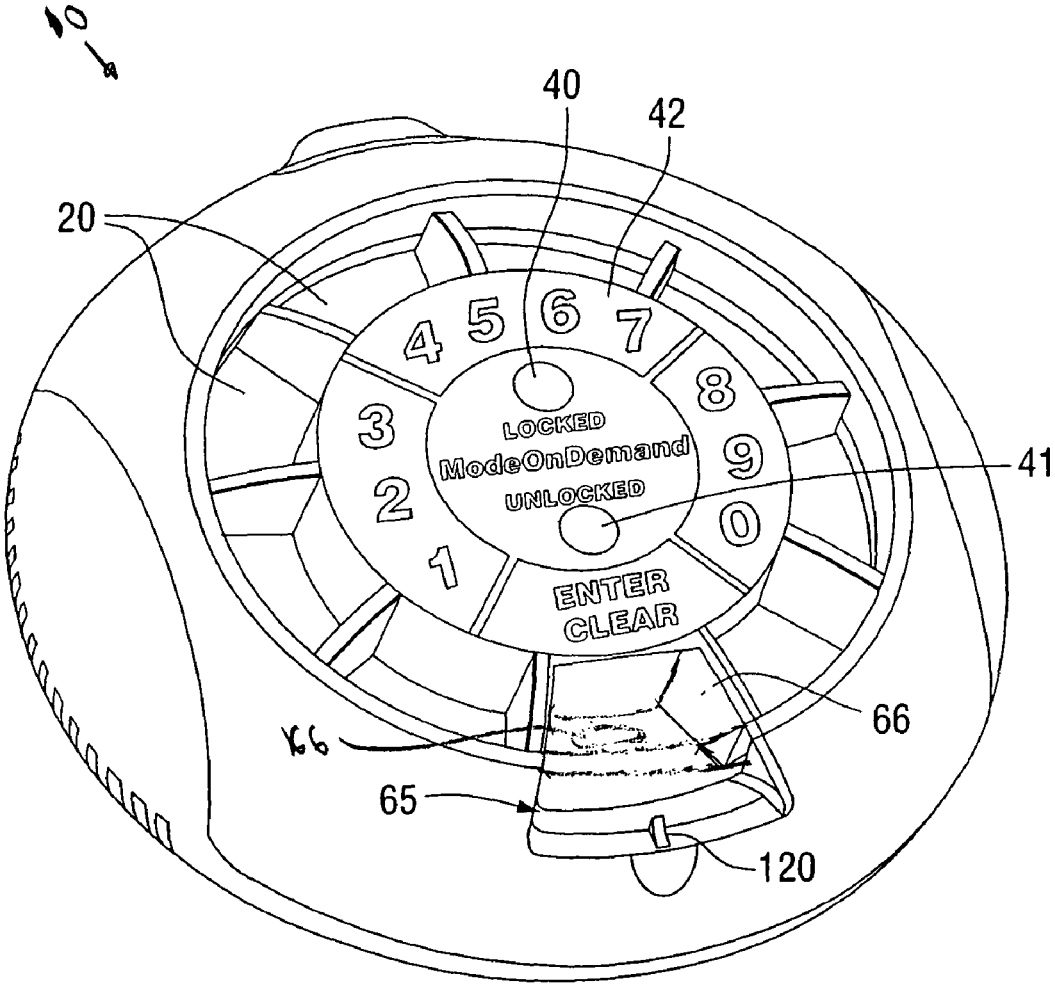
FIG. 6 is a top view of another embodiment of the medication on demand device.

In another embodiment of the present invention, the door 65 is lockable and controllable by operation of the controller 30, such that a door lock 120 in FIG. 6 is released only after the minimum dosing interval has elapsed. In this embodiment, rotation of the medication tray 16 by operation of the motor 44 under control of the controller 30 can occur at any time during the dosing interval, as the patient cannot gain access to the medication dose 66 until the door 65 is unlocked by operation of the lock 120.

Figure 10:
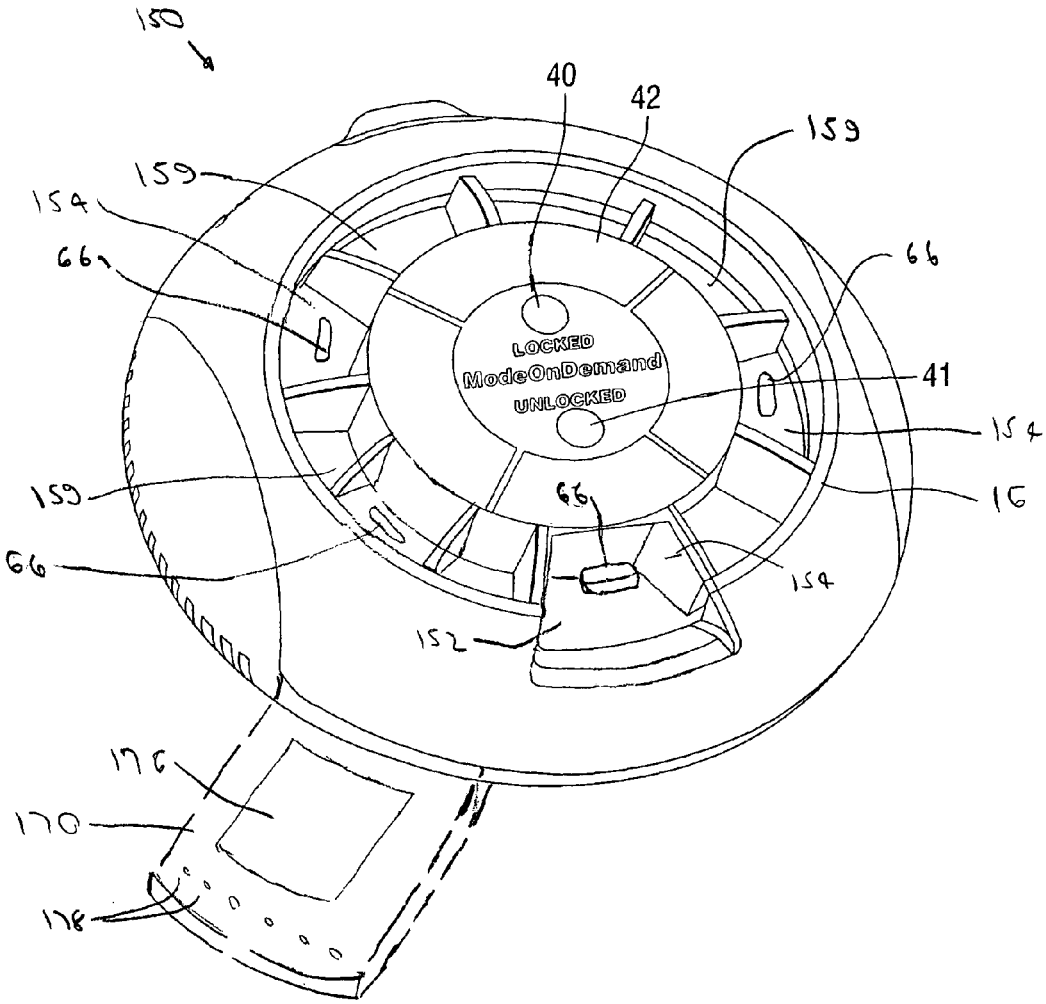
FIG. 10 is a perspective view of another embodiment of a medication on demand device according to the teachings of the present invention.

FIG. 10 illustrates an embodiment of a medication on demand device 150 including an opening 152. Unlike the embodiments described above, the embodiment of FIG. 10 lacks the locking door 65. Instead, the motor 44 under control of the controller 30, rotates a medication-containing compartment 154 into alignment with the opening 152 after the minimum dosing interval has elapsed and after the user has been identified (according to one of the identification techniques described above) as the authorized patient, permitting the patient to remove a medication dose 66 from the compartment 154 through the opening 152.

The patient has a predetermined time in which the medication dose 66 is accessible through the opening 152. After this time has elapsed (in one embodiment, about 25 seconds, which should be a sufficient time for the patient to remove the medication dose 66), the medication tray 16 is rotated by action of the motor 44 under control of the controller 30, such that an empty compartment 159 is aligned with the opening 152. The medication on demand device 150 remains in this configuration until the timer 36 determines that the minimum dosing interval has elapsed, at which time the indicator 40 is illuminated, indicating that the minimum dosing interval has elapsed. The medication tray 16 is then rotated (subject to patient authorization) such that another compartment 154 containing a medication dose 66 is aligned with the opening 152. The medication tray 16 remains in this position for the predetermined time after which another timing cycle begins. To accommodate this embodiment, the medication tray 16 comprises alternating empty compartments 159 and medication-carrying compartments 154. Any of the above described or otherwise available identification techniques can be employed to provide patient authorization.

According to another embodiment as further illustrated in FIG. 10, the medication on demand device 150 further comprises a tray 170 locked into a closed position within the device 150 and releasable therefrom into an open or extended position as illustrated in FIG. 10. According to various embodiments, the tray 170 comprises a display 176 and/or user-activated keys 178 for use in combination or independently to program the medication on device 150 as described above. In particular, the device 150 must be programmed with a physician-ordered dosing interval and patient identification information from which an authorized patient is determinable.

In yet another embodiment, the device 150 is programmed using a stylus or pen interacting with the display 176 as is known in the art. After the device is programmed, the tray 170 is returned to the closed/locked position within the device 150. Various mechanical locking devices are known for locking the tray 170 in position while permitting convenient release of the lock when it is desired to program the device 150. The display 176 and the keys 178 can also be used to query the device 150, for example to determine when the medication doses 66 have been self-administered.

In yet another embodiment, in lieu of using the components of the tray 170 to program the device 150, the device 150 comprises wireless communications equipment (not illustrated in FIG. 10) for receiving and processing radio frequency signals to program and/or query the device 150. The signals can be transmitted from a nurse's station to devices 150 in the area in use by patients, from a medication cart that is used by a nurse to deliver medications to patients, and/or from a central pharmacy responsible for supply the medication tray 16 having the medication dose contained therein.

In certain use scenarios for the device 150, the nurses and/or the central pharmacy program the device 150 to establish the minimum dosing interval and query the device 150 to determine when it is necessary to provide a new medication tray 16, as the patient has self-administered all the available medication doses 66. Querying of the device 150 by the pharmacy or the attending nurse also reveals when the patient has self-administered a medication dosage, information that is then included on the patient's medical record and invoiced against the patient's financial record. Every administered medication dose is also tracked by a pharmacy inventory system such that when a dose is administered it is deleted from inventory.

Figure 11:
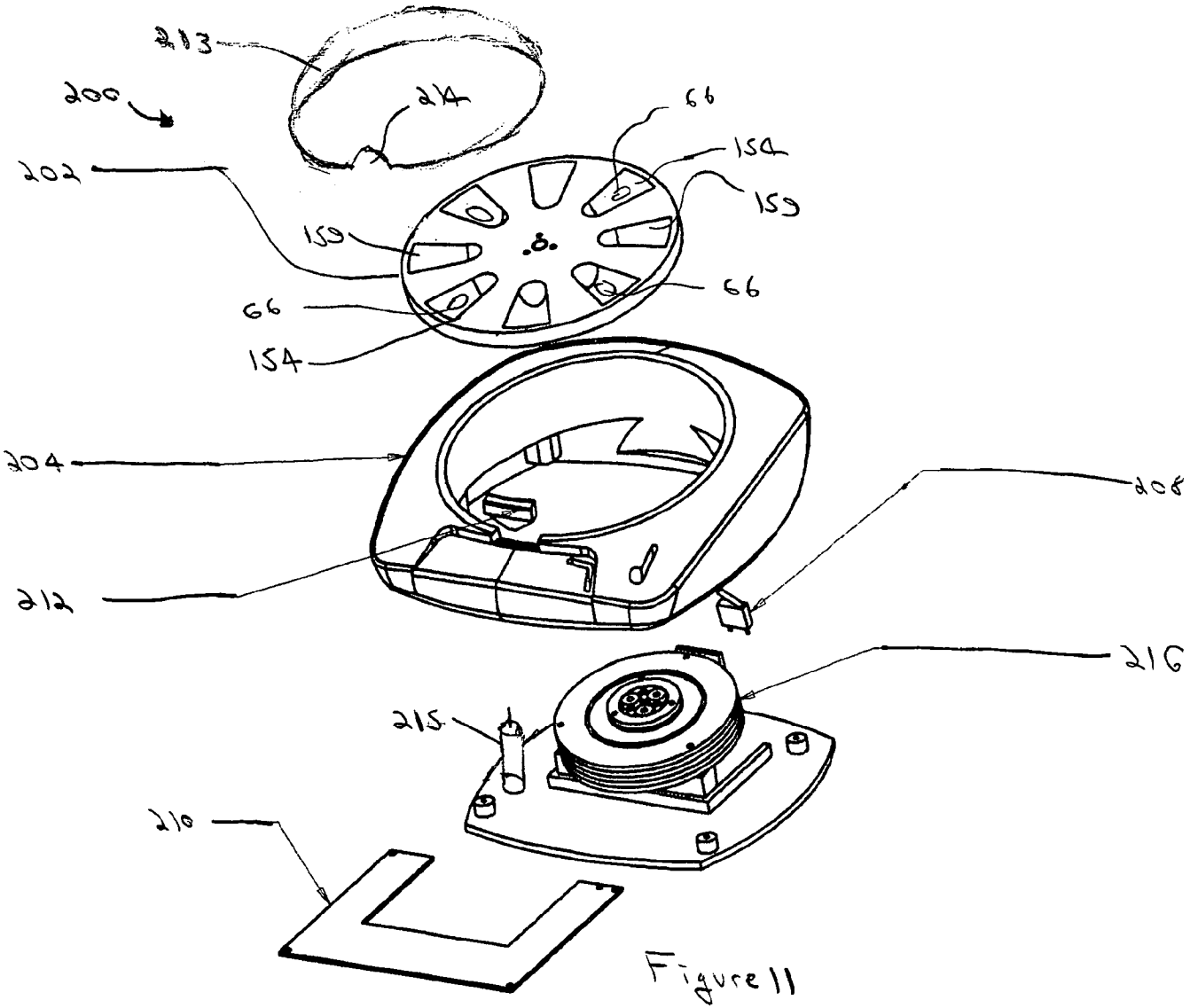
FIG. 11 is an exploded view of another embodiment of a medication on demand device constructed according to the teachings of the present invention.

FIG. 11 illustrates yet another embodiment of a medication on demand device 200 comprising a housing 204 for receiving a removable drug tray 202 further comprising compartments 20/154/159 therein. A tray indexing switch 208 detects movement of the tray 202 for recording by control components mounted on a printed circuit board 210. Rotation of the tray 202 as detected by the indexing switch 208, indicates when medication doses have been self-administered, from which it can be determined when the tray 202 is empty. As described above this information is useful for both the patient's medical and financial records. The device 200 further comprises an indicator 212 for indicating that the device is ready to provide access to another medication dose 66.

A dome 213, comprising a transparent (in one embodiment) hemispherical or flat cover, overlies the drug tray 202 and defines an opening 214 therein. As descried above, the drug tray 202 is rotated to allow the opening 214 to align with one of the compartments 154/159. The tray 202 is configured in either an open position with the medication dose 66 accessible by the patient through the opening 214 or in a closed position with a blank or empty compartment 159 aligned with the opening 214. The dome 213 is removable to replace the tray 202 with a new tray 202 properly loaded with medication doses 66 for the patient. In another embodiment the dome 213 is pivotally attached to the housing 204.

The device 200 further comprises a solenoid 215 that engages the dome 213 to prevent unauthorized tampering with or removal of the dome 213 to access the medication doses 66. The solenoid 215 is disengageable when it is necessary to load a new tray 202 into the housing 204. According to the embodiment including the solenoid 215, the commands entered through the user interface (the key pad 42 of FIG. 1 or any wired or wireless network as described above) comprise: unlock the dome 213 by disengaging the solenoid 215, setting the dispensing interval and providing identification information for the authorized user.

According to the embodiment of FIG. 11, the tray 202 is caused to rotate by a planetary gear 216 driven by the motor 44.

According to yet another embodiment, a nurse or physician can override the dosing interval as programmed into the device 10/150/200, permitting immediate rotation of the medication tray 16/202 into a position where a dose is accessible of patient administration. The override can be accomplished using the keypad 42, the bar code reader 90, the RFID tag reader 100 or the smart card reader 107 or programming components associated with the tray 170.

Figure 12:
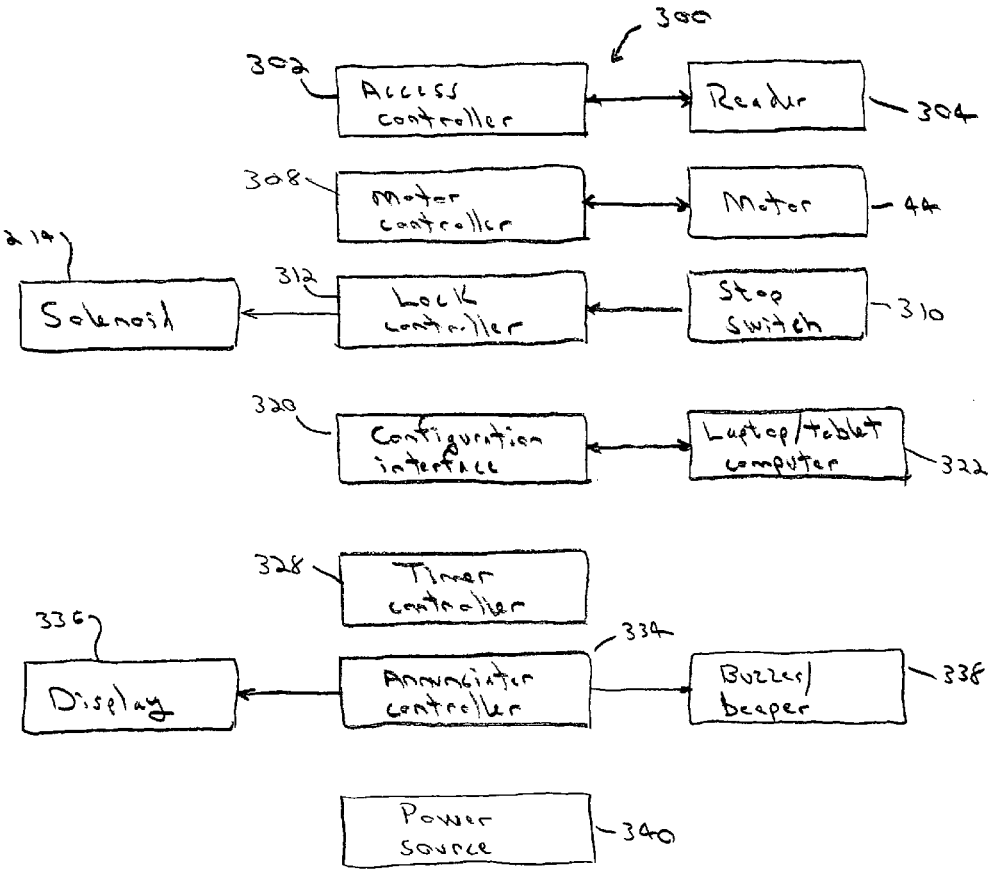
FIG. 12 illustrates a functional block diagram of the controlling and the controlled components according to one embodiment of the present invention.

FIG. 12 illustrates a block diagram of one embodiment of a controller 300 and controlled components of a medication on demand device according to one embodiment of the present invention. The controller 300 comprises an access controller 302 responsive to a reader 304, further comprising the bar code reader 90, the RFID reader 100 and/or the smart card reader 107 described above, or another device for identifying a person as an authorized patient. A motor controller 308 controls the motor 44 as described above. A stop switch 310 determines that the tray 16/202 has stopped rotating and in response to a lock controller 312, the solenoid 214 is engaged.

A configuration interface 320 interfaces with the programming mechanism, such as the laptop/tablet computer 322 illustrated (or any of the other programming techniques and apparatuses described herein) to program the controller 300 with respect to the various programmable features, e.g., dosing interval, identification information.

A timer controller 328 controls the various time-driven components of the device. An annunciator controller 334 controls a display 336 (including the clock 48 described in conjunction with FIG. 5) to display real time or the time remaining until the next dose is permitted, i.e., accessible through the opening 152/214. The controller 334 also controls a buzzer/beeper 338 to provide an audible indication when the next medication dose is permitted. Power is supplied to the device via a power supply 340, comprising the batteries 76 in the embodiment of FIG. 3 or another power source as desired.

As known by those skilled in the art, the various components of the controller 300 illustrated in FIG. 12 are in communications with other components thereof to effectuate control of the features and functions of the medication on demand device.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments set forth herein. In addition, modifications may be made to adapt the teachings of the present invention to a particular application without departing from its essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for dispensing a medication dose from a medication dispenser for a patient on a variable, as-needed basis, wherein the patient controls administration of the medication doses, wherein the doses are not available more frequently than a prescribed minimum dosing interval between doses, wherein the medication dispenser comprises a plurality of compartments with an empty compartment between two successive medication-containing compartments when initially filled, the method comprising:

(a) starting a timer when a prior dose is accessible through an opening in the medication dispenser;

(b) determining when the timer has reached a count value indicating that the minimum dosing interval has elapsed;

(c) activating an indicator when it has been determined at step (b) that the minimum dosing interval has elapsed;

(d) responsive to an authorization process executed any time after the minimum dosing interval has elapsed when the patient desires a medication dose, determining that the patient is an authorized person;

(e) after successful authorization of the patient at step (d), moving a medication-containing compartment into alignment with the opening, wherein the dose is accessible through the opening, wherein if the authorization is unsuccessful or the patient elects not to execute the authorization process the medication-containing compartment is not moved into alignment with the opening; and (f) after a predetermined time interval from alignment of the medication-containing compartment with the opening, moving the medication-carrying compartment away from the opening and moving an empty compartment into alignment with the opening so that a medication dose is not accessible, wherein the predetermined time interval is shorter than the minimum dosing interval;

(g) repeating steps (a) through (f).

2. The method of claim 1 wherein the step (c) further comprises in response to identification information supplied by the person, determining that the person is the authorized person.

3. The method of claim 2 wherein the identification information comprises at least one of a code entered on a keypad of the medication dispenser, a bar code, an RFID tag code, a fingerprint, a voice print or information supplied by a smart card.

4. The method of claim 1 wherein the first predetermined time interval comprises a physician-prescribed minimum interval between as-needed doses.

* * * * *